US005915884A

United States Patent [19]

Gates et al.

[11] Patent Number: 5,915,884

[45] Date of Patent: Jun. 29, 1999

[54] ARCUATE END CORRUGATED PAPER FORM VOID

[75] Inventors: Robert C. Gates, Lakewood; Michael L. Turner, Englewood, both of Colo.

[73] Assignee: Surevoid Products, Inc., Englewood, Colo.

[21] Appl. No.: 08/763,765

[22] Filed: Dec. 11, 1996

[51] Int. Cl.[6] ..... B28B 7/16; E02D 5/34; E02D 5/38

[52] U.S. Cl. ..... 405/232; 405/257; 249/52

[58] Field of Search ..... 405/232, 257, 405/303, 216; 249/10, 52, 48, 51

[56] References Cited

U.S. PATENT DOCUMENTS 926,269 6/1909 Magdiel ..... 249/52

*Primary Examiner*—Tamara L. Graysay
*Assistant Examiner*—Tara L. Mayo
*Attorney, Agent, or Firm*—Richard W. Hanes

[57] ABSTRACT

An arcuate end form void for providing a space between a poured concrete structure and an underlying expansive soil adjacent a round pier is formed of corrugated paper to provide temporary support of wet concrete, and conforms to the pier radius to prevent passage of wet concrete between the pier and form void.

19 Claims, 4 Drawing Sheets

ARCUATE END CORRUGATED PAPER FORM VOID

BACKGROUND OF THE INVENTION

This invention relates generally to the construction of concrete walls, slabs or other structures adjacent to or inclusive of spaces. More particularly, this invention pertains to void forms for creating spaces beneath concrete structures to separate and protect the structures from underlying expansive soils.

Expansive soils are prevalent in many areas of the United States, as well as in other countries. Such soils typically contain much clay, and expand and contract considerably as a result of cyclical changes in moisture content and/or as a result of natural freezing-thawing cycles.

A common method of construction in such expansive soils uses spaced drilled piers or spread footings for supporting the walls and floors. In this method, the concrete walls or beams supported by the piers or footings must be provided with a substantial spacing from the expansive underlying soil. Otherwise, the upward expansion of the soil may contract and force the beams or walls upward, causing cracking and deformation of the concrete. Without the required spacing, the integrity of the concrete structure is eventually lost.

Excavation of soil from beneath a concrete structure after it has "set" is a labor-intensive, very expensive method for resolving the problem with expansive soils. Where the structure has a lower edge below grade, a trench sufficiently wide to permit hand removal of soil below the structure must be provided. Furthermore, it is desirable to remove any forms of wood, metal or plastic used to form the lower surface of the structure. Such forms have a long life and should be removed after the concrete has set to provide further expansion space below the structure, and for re-use.

The use of integral corrugated paper form voids is known. In one application, such form voids are placed at the bottom of wall forms and trenches to separate the subsequently poured concrete from the ground. The corrugated paper form voids have sufficient temporary strength to support the wet concrete at a distance above the ground, but gradually absorb water and deteriorate to a condition where they no longer provide support. However, by this time the concrete has set and needs no support other than that provided by the piers. During periods of upward expansion of the underlying soil, the soil occupies the space left by the deteriorated or weakened form voids.

Form voids are available in various cross-sectional configurations. The generally rigid form voids are prepared by forming the desired structural shape of panels of corrugated paper and joining the panels together with adhesive. An internal cellular grid structure may be used within the form void to increase the strength of the form void as required.

It has been common practice to abut square-ended form voids to round piers, resulting in the flow of wet concrete downward between the pier and form void. While the quantity of this misdirected concrete is relatively small, it has been found that it nevertheless may provide a lower surface against which expanding soils may apply upward forces to distort or damage the concrete structure.

BRIEF SUMMARY OF THE INVENTION

An arcuate end form void is prepared from corrugated paper and has a structure compatible with existing form voids and with a collapsible form void which is the subject of two other applications by the same applicants, i.e. Ser. No. 08/723,477, filed Oct. 9, 1996 (Attorney Docket No. 213.600) and Ser. No. 08/763,408, filed concurrently herewith (Attorney Docket No. 213.700).

The paper from which the arcuate end form void is manufactured is like that from which paper cartons are typically formed, i.e. a corrugated paper structure sandwiched and cemented between two sheets of thin cardboard. The corrugated paper has greater resistance to bending in the direction of the corrugation ribs or ridges than across the ridges, hence a corrugation ridge direction is maintained parallel to the direction of applied compressive forces to increase the weight of wet concrete which may be supported.

The arcuate end form void has a circular concave end about a vertical axis, and has a diameter designed to be generally equivalent to the diameter of the pier or column against which it will be placed.

Often, a concrete beam is desirably formed at an elevation higher than the tops of the originally poured piers upon which it is to rest. The round end form void becomes the form for an intermediate concrete structure between the original pier and the beam. Thus, it must not only withstand vertical forces on its upper surface, but horizontal forces directed at the rounded end as well.

The corrugated paper as used in the manufacture of the form void described herein is readily obtainable from numerous sources.

A substantial portion of the exterior surfaces of the paper form voids is coated or impregnated with a water resistant material such as wax to provide temporary water resistance and thus an appropriate time delay in deterioration.

As used, the arcuate end form void enables the formation of a predetermined spacing of a concrete structure from an underlying soil to extend all the way to the piers.

This and other objects and advantages of the invention will be readily understood by perusal of the following description in conjunction with study of the accompanying figures of the drawings wherein like reference numerals have been applied to designate like elements throughout the several views.

DESCRIPTION OF THE PREFERRED EMBODIMENTS

Figure 1:
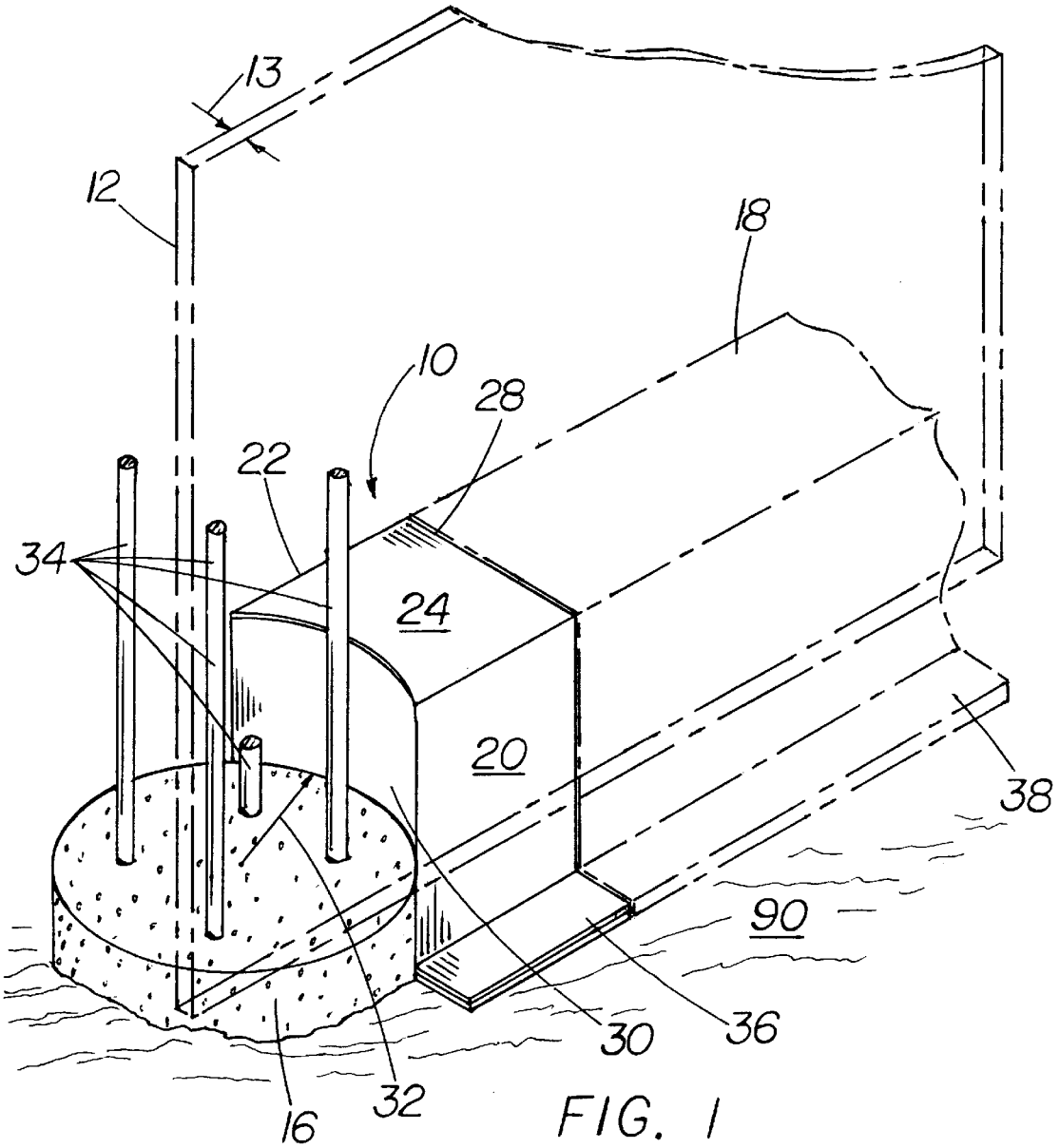
FIG. 1 is a perspective partially cutaway side view of an arcuate end form void of the invention in place for forming a concrete beam supported on piers.

With reference to the drawings, and particularly to FIG. 1, a round end form void 10 is shown as used in conjunction with flat end form voids 18 and vertical concrete forms 12 for making a concrete structure 14, e.g. a beam (see FIG. 1A) to be supported by pier 16. While only one form 12 is depicted (in phantom) adjacent the proximate side wall 20 of the form void 10, it is to be understood that a second form 12 will be located adjacent the distal side panel 22 as well. The beam 14 is fabricated by pouring wet concrete between the spaced apart forms 12. Beam 14 will have a bottom surface determined by the upper panel 24, and side surfaces determined by the forms 12. The form voids 10 and 18 ensure that the beam will be formed at a sufficient vertical distance above the underlying ground 90 to prevent expansive soils from damaging the structure.

Figure 2:
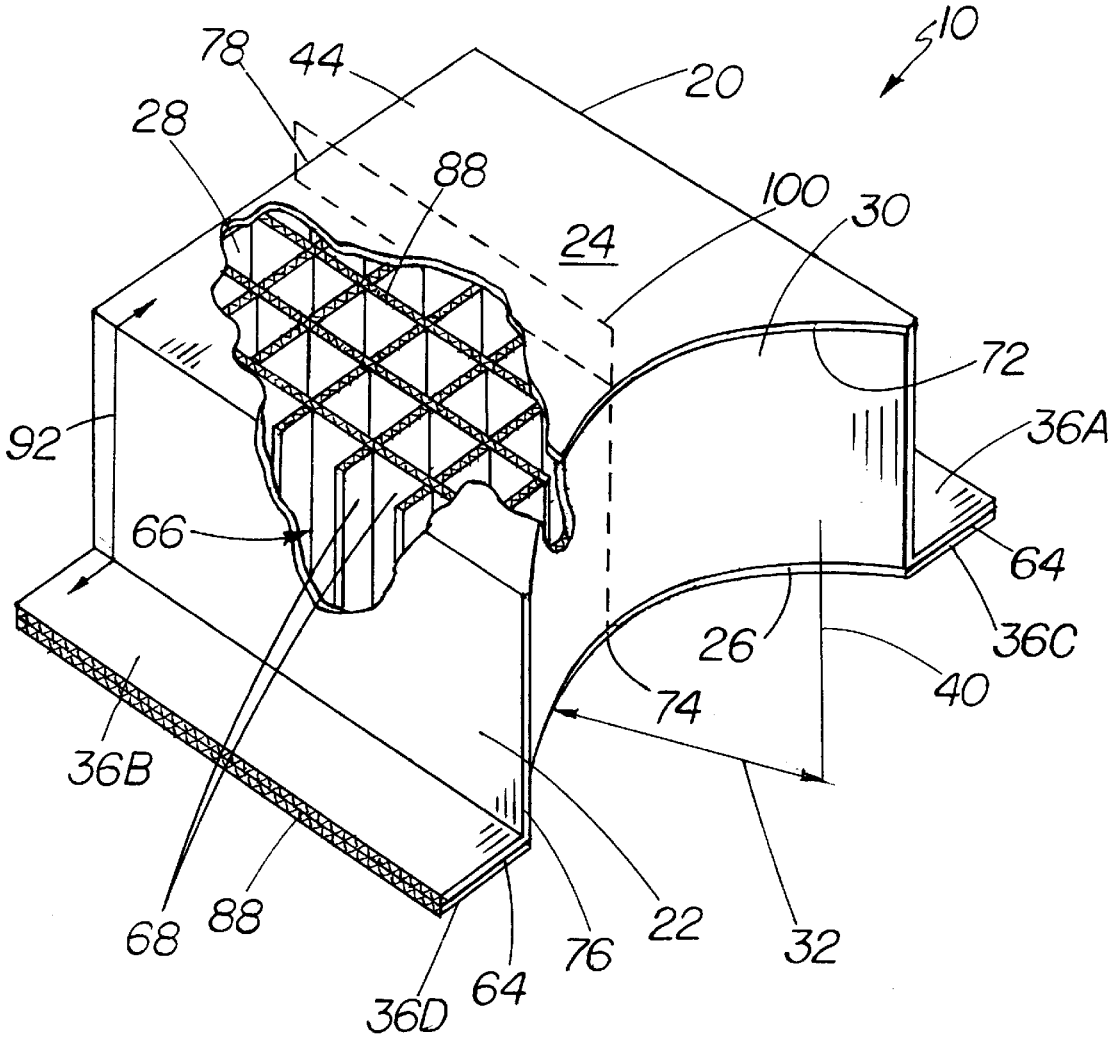
FIG. 2 is a perspective partially cutaway side view of an arcuate end form void of the invention.

In FIGS. 1 and 2, the arcuate end form void 10 is shown as having planar side panels 20, 22, planar upper panel 24, planar base panel 26, planar flat end panel 28, and concave arcuate end panel 30. The flat end panel 28 abuts the flat end form void 18. The arcuate end panel 30 is configured to conform to the radius of curvature 32 of the pier 16 about central axis 40 so that it fits snugly against the pier, preventing any appreciable leakage of wet concrete around the pier. In the construction procedure illustrated in FIG. 1, the forms 12 are supported by the piers and reinforcing rods 34 tie the pier 16 and beam 14 together. The form void 10 is shown with bottom flange 36, and the flat end form void 18 is shown with a matching bottom flange 38.

Figure 4:
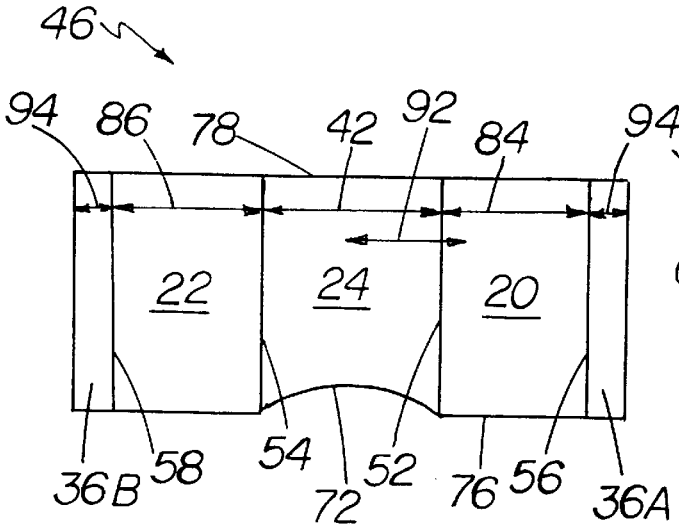
FIG. 4 is a plan view of a first sheet of corrugated paper used to construct an arcuate end form void of the invention.
Figure 5:
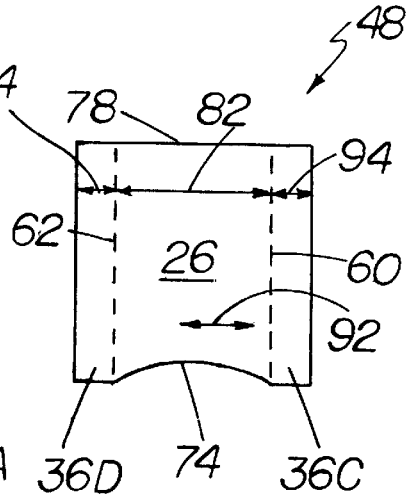
FIG. 5 is a plan view of a second sheet of corrugated paper used to construct an arcuate end form void of the invention.
Figure 6:
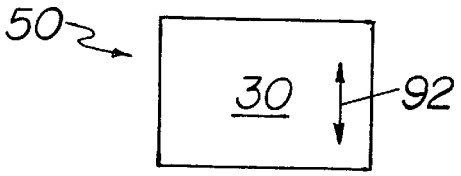
FIG. 6 is a plan view of a third sheet of corrugated paper used to construct an arcuate end form void of the invention.

FIG. 2 shows one embodiment of the arcuate end form void 10. The form void 10 has an upper panel 24 with a width 42 conforming to the desired wall or beam thickness. The form void 10 has a bottom flange 36 projecting out from each side panel 20, 22. As shown in FIGS. 4 to 6, the outer shell 44 may be formed of three sheets 46, 48 and 50 of corrugated paper.

First sheet 46 has fold lines 52 and 54 on either side of the upper panel 24 separating upper panel 24 from first and second side panels 20, 22, respectively. Fold lines 56 and 58 separate the first and second side panels 20, 22 from the corresponding bottom flange portions 36A and 36B. The fold lines 52, 54, 56, and 58 are parallel and extend from the first end 76 to the second end 78 of the form void 10. As shown, the arcuate edge 72 intersects the fold lines 52 and 54 of side panels 20, 22.

Second sheet 48 is not folded, but has a central base panel 26 defined by adhesive lines 60, 62 which separate the bottom flange portions 36C and 36D from the base panel. like upper panel 24 with concave arcuate edge 72, base panel 26 has a concave arcuate edge 74.

The shell 44 is formed by erecting the first sheet 46 by bending along the fold lines 52, 54, 56 and 58, and using adhesive 64 to join flange portion 36A to flange portion 36C, and flange portion 36B to flange portion 36D, thus forming the two bottom flanges 36.

An internal support structure 66 is placed within the shell 44 to provide the necessary crush resistance to forces directed (a) downward on the upper panel 24 and (b) horizontally on the arcuate end panel 30. As shown in FIG. 2, a rigid cellular grid 68 may be formed of corrugated paper panels which are aligned in opposed vertical planes and glued together. One of the grid panels may comprise the flat end panel 28 for the second end 78 of the form void 10. The grid 68 is formed with a concave end conforming to the curvature of the upper panel 24 and base panel 26. In an alternate arrangement, the concave curve may be cut after the grid 68 is placed within the shell 44. The grid 68 may be cemented within the shell 44 to increase the rigidity and strength of the form void 10.

The third sheet 50 comprises an arcuate end cap 30 which is bent to the given grid radius of curvature 32 and cemented to the grid 68 and outer shell 44. The corrugation ribs or ridges 88 lie in a vertical direction 92 to provide the greatest strength for supporting the wet concrete without leakage past the end cap 30.

As shown in FIGS. 4–6, the width 82 of the base panel 26 and the width 42 of the upper panel 24 are generally equal. The widths 84, 86 of the side panels 20, 22 are generally equal and comprise the eventual minimum spacing between the concrete structure and the underlying ground 90.

The corrugation ribs or ridges 88 of the outer section panels are preferably oriented as extending in direction 92, in order to provide the greatest strength in the direction of downwardly applied forces.

Figure 1A:
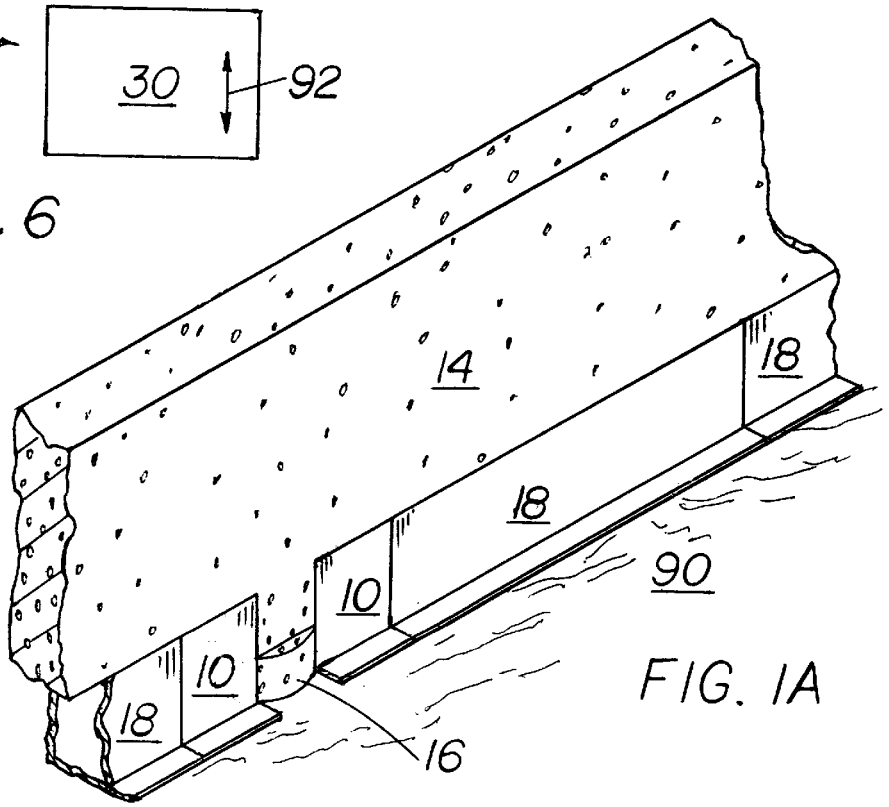
FIG. 1A is a perspective partial side view of a hardened concrete structure with arcuate end form voids of the invention in place after removal of forms.

The form void 10 is manufactured with sufficient initial strength to support the wet concrete poured between the forms 12, and weakens and disintegrates in time upon passage of ground moisture and moisture from the wet concrete into the paper fibers. When the concrete has set and forms 12 removed, as depicted in FIG. 1A, the beam 14 or other structure so formed is supported entirely by the piers 16. The arcuate end form voids 10 and associated form voids 18 remain beneath the beam 14 and rapidly deteriorate and disintegrate to a non-supportive state. The ground 90 (including expansive soils therein) underlying the beam 14 is spaced from the beam and may rise upwardly toward the beam without contacting it or exerting a high force thereon. Thus, the common destructive effects of expanding soils on concrete structures may be avoided.

The width 94 of the bottom flange or flanges 36 is sufficient for a standard form 12 to hold the form void 10 in place where the form is to rest on the flange. The form 12 may have a thickness 13 (FIG. 1) either greater than, equal to, or less than the flange width 94. The flanges 36 provide stability to the form void 10 and optionally provide a surface upon which the forms 12 may rest. Optionally, the arcuate end form void 10 may be configured with a single bottom flange 36, or none at all.

The panels joined by adhesive 64 in this form void 10 have the greatest strength when the layer of applied adhesive 64 is continuous between those panels so joined. However, non-continuous, e.g. spot, application of adhesive may optionally be done, resulting in a slight loss in strength.

The adhesive 64 may be of any composition which will tightly bond the corrugated paper panels. Preferably, however, the adhesive 64 is biodegradable, as typified by adhesives with a starch base.

Figure 3:
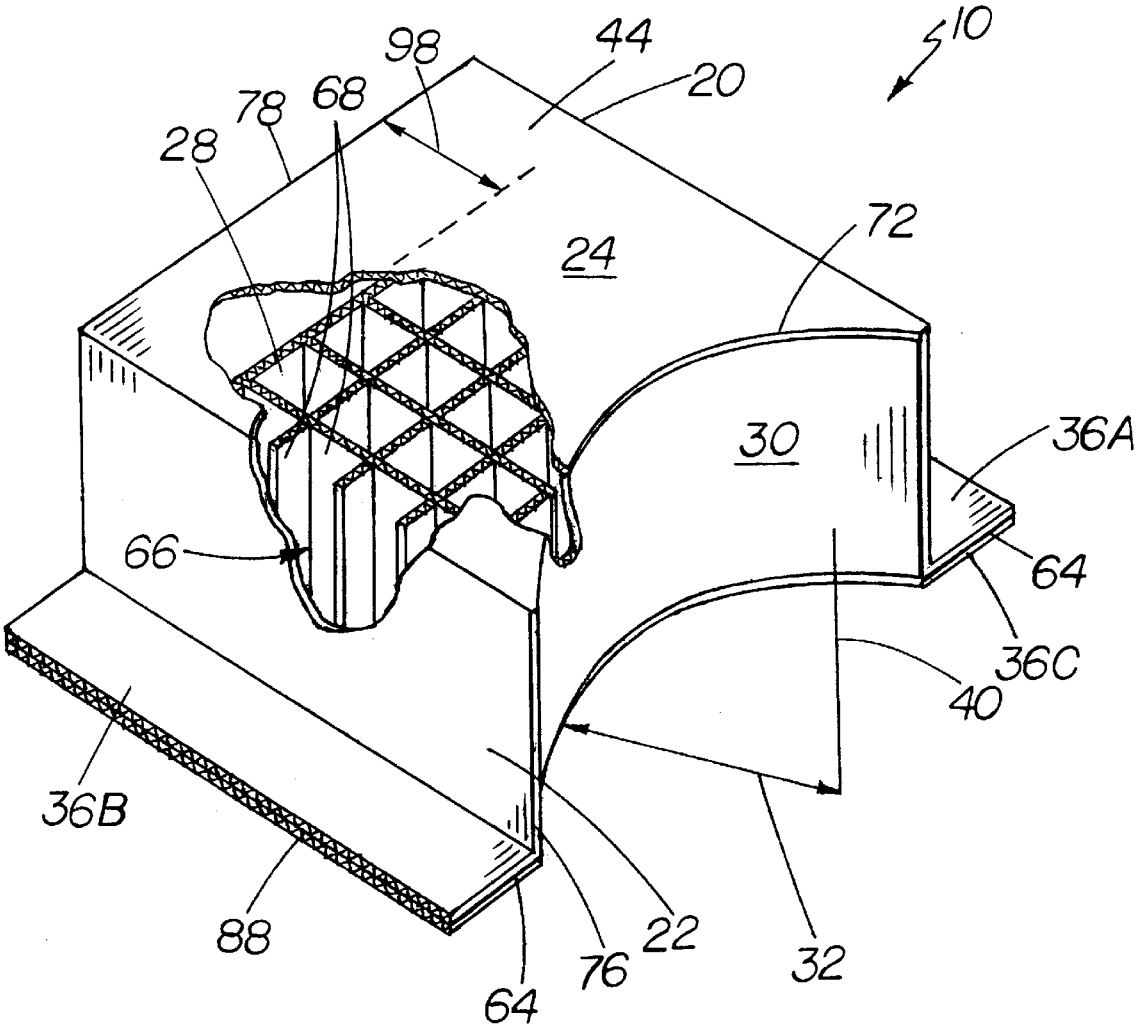
FIG. 3 is a perspective partially cutaway side view of a further embodiment of an arcuate end form void of the invention.

It should be noted that a more cohesive form void structure may be erected at a job site by using an inner supportive part to join several outer parts together, end-to-end. Thus, separate portions of the inner parts are inserted into each of several outer parts. In this way, the need for end caps is reduced or may be avoided altogether. As shown in FIG. 3, the shell 44 is only partially filled with the supporting structure 66, leaving the second end 78 of the shell 44 open to receive an inner part which is described and claimed in applicants' co-pending application, Ser. No. 08/763,408, filed concurrently herewith (Attorney Docket No. 213.700). The inset distance 98 between the second end 78 and the flat end panel 28 may be from about 0.5 inch to several inches or more.

As well known in the art, corrugated paper is constructed from an intermediate sheet of paper in which are formed multiple parallel reverse bends; the intermediate sheet is then cemented between parallel planar sheets of paper which form the opposing surfaces. The shell 44 and support structure 66 may be formed of several plies or layers of corrugated paper sheets 46, 48, 50 which are bonded together with adhesive 64.

The opposing surfaces of the corrugated paper may have different inherent strengths due to differences in paper thickness or type of paper. These differences may be used to vary the overall strength of the arcuate end form void 10. Where more than one ply or layer of corrugated paper is used to form a panel, the greatest strength results when the panel is configured to have the stronger paper surfaces exposed, i.e. on the exterior of the panel.

The exposed exterior surfaces of the arcuate end form void 10 are coated or impregnated with a water resistant material such as wax. The water resistant material delays the deterioration of the form void 10 until the concrete has set and is fully supported by the piers 16 above the underlying ground 90.

The size of the form void 10 will vary, depending upon the dimensions of the concrete structure 14 which is to be poured, and the desired spacing from the ground 90. Thus, for constructing a wall having a thickness of 6 inches (15.25 cm) with 4 inches (10.16 cm) of ground clearance, the width 42 of panel 24 will be about 6 inches and the widths of panels 20 and 22 about 4 inches.

The length 96 of the completed form void 10 may vary, but for many uses may be less than 8 inches. The flat end form voids 18 which will be used with form void 10 may be easily cut on-site to any desired length with a knife or saw.

Although the form void 10 illustrated in the figures is symmetrical about a central longitudinal vertical plane 100 (see FIG. 2), a non-symmetrical design may alternatively be used. For example, upper panel 24 may be non-parallel with base panel 26 to produce a beam or wall 14 with a non-horizontal bottom surface. The resulting load-bearing strength may be asymmetrical across the width of the upper panel 24, but may be computed using known methods of static and dynamic analysis.

Of course, the form void 10 may be configured with a trapezoidal cross-sectional shape by changing the dimensions of panel width and height. An inner supportive structure 66 may be shaped to fit within the non-rectangular shell 44.

There are numerous ways to vary the strength of the form void 10. First, a corrugated paper panel of different thickness or design strength may be used. Second, one or more panels may be formed of more than a single ply of corrugated paper, the panel(s) thus being formed by cementing the plies or layers of corrugated paper material together with an adhesive 64. Third. The interior support structure 66 may be widely varied in panel density, degree of cementation, and design. Fourth, the adhesive may be applied in a continuous or non-continuous pattern.

While the use of the form void 10 is particularly described relative to the construction of a concrete beam formed with vertical forms 12, it is understood that the form void 10 may also be used for constructing other types of concrete structures.

It is anticipated that various changes and modifications may be made in the construction, arrangement, operation and method of construction of the form void disclosed herein without departing from the spirit and scope of the invention as defined in the following claims.

What is claimed is:

1. An arcuate end form void for establishing a space beneath a concrete structure adjacent a round pier, comprising:

an outer shell formed of connected panels of corrugated paper comprising a planar upper panel, a base panel, first and second side panels, and a concave arcuate end cap having a radius about a vertical axis; and an inner supportive structure cemented within said outer shell, said supportive structure comprising panels of corrugated paper extending between said upper panel and said base panel and cemented to said arcuate end cap for providing rigidity and resistance to crushing.

2. The arcuate end form void of claim 1, wherein said arcuate end cap extends in a concave arc between said first and second side panels.

3. The arcuate end form void of claim 1, wherein said upper panel, said base panel and said side panels are formed of a single sheet of corrugated paper.

4. The arcuate end form void of claim 1, wherein said upper panel, said base panel and said side panels comprise a rectangular parallelogram in cross-section.

5. The arcuate end form void of claim 1, wherein said upper panel, said base panel and said side panels comprise a trapezoid in cross-section.

6. The arcuate end form void of claim 1, wherein said upper panel, said base panel and said side panels are symmetrical about a longitudinal vertical plane.

7. The arcuate end form void of claim 1, wherein said upper panel is parallel to said base panel.

8. The arcuate end form void of claim 1, wherein said upper panel is non-parallel with said base panel and said form void is non-symmetrical about a longitudinal vertical plane.

9. The arcuate end form void of claim 1, wherein said inner structure comprises a cellular grid of vertical panels aligned in opposing directions and joined by adhesive.

10. The arcuate end form void of claim 9, further comprising a flat end opposite said arcuate end, wherein one of said vertical panels comprises the flat end.

11. The arcuate end form void of claim 1, further comprising a flat end opposite said arcuate end, wherein said inner supportive structure extends from said arcuate end cap to a point inset from said flat end by a distance of between about 0.5 and about 4 inches, for insertion therein of a slidable internal structure connecting said arcuate end form void to the flat end.

12. The arcuate end form void of claim 1, further comprising a planar end cap on the form void end opposite said arcuate end.

13. The arcuate end form void of claim 1, further comprising at least one bottom flange extending outwardly from the intersection of one of said side panels of said first and second side panels with said base panel.

14. The arcuate end form void of claim 1, wherein said corrugated paper contains corrugation ribs oriented at right angles to the parallel longitudinal fold lines defining said panels of said shell.

15. The arcuate end form void of claim 1, further comprising a coating of water repellent material on a major portion of the exterior exposed surfaces of said arcuate end form void to delay absorption of moisture and the resulting deterioration of said form void.

16. The arcuate end form void of claim 15, wherein said water repellent material comprises wax.

17. The arcuate end form void of claim 1, wherein said arcuate end of said form void is configured to be positioned against the curved side of a circular vertical pier.

18. The arcuate end form void of claim 1, further comprising an impregnation of water repellant material on a major portion of the outer shell of said arcuate end form void to delay adsorption of moisture and the resulting deterioration of said form void.

19. The arcuate end form void of claim 18, wherein said water repellant material comprises wax.

* * * * *